US008087544B2

(12) United States Patent
Elsom et al.

(10) Patent No.: US 8,087,544 B2
(45) Date of Patent: Jan. 3, 2012

(54) SYSTEM FOR MIXING BEVERAGE COMPONENTS IN A PREDETERMINED RATIO

(76) Inventors: Kyle B Elsom, Batavia, IL (US); Gregory M Billman, Hoffman Estates, IL (US)

( * ) Notice: Subject to any disclaimer, the term of this patent is extended or adjusted under 35 U.S.C. 154(b) by 1495 days.

(21) Appl. No.: 11/508,359

(22) Filed: Aug. 23, 2006

(65) Prior Publication Data

US 2008/0047973 A1 Feb. 28, 2008

(51) Int. Cl.
*B67D 7/14* (2010.01)

(52) U.S. Cl. ..... 222/57; 222/129.1

(58) Field of Classification Search ..... 222/129.1, 222/57, 59, 129.3, 71, 63, 133; 137/8, 98, 137/100

See application file for complete search history.

(56) References Cited

U.S. PATENT DOCUMENTS 4,955,507 A * 9/1990 Kirschner et al. ..... 222/63
4,979,639 A * 12/1990 Hoover et al. ..... 222/1
5,143,257 A * 9/1992 Austin et al. ..... 222/57
5,179,970 A * 1/1993 Jarocki et al. ..... 137/9
5,190,068 A * 3/1993 Philbin ..... 137/8
5,381,926 A * 1/1995 Credle et al. ..... 222/1
5,673,820 A * 10/1997 Green et al. ..... 222/129.3
6,269,973 B1 * 8/2001 Bennett et al. ..... 222/1
6,450,369 B1 * 9/2002 Heyes ..... 222/129.1
6,536,626 B2 * 3/2003 Newman et al. ..... 222/39
6,648,240 B2 * 11/2003 Simmons ..... 239/63
6,705,489 B2 * 3/2004 Henry et al. ..... 222/129.1
6,807,460 B2 * 10/2004 Black et al. ..... 700/244
6,871,674 B2 * 3/2005 Thomas et al. ..... 141/9
7,077,290 B2 * 7/2006 Bethuy et al. ..... 222/23
7,225,946 B2 * 6/2007 Gardos ..... 222/1
7,437,944 B2 * 10/2008 Melcer et al. ..... 73/861
2005/0145650 A1 * 7/2005 Henry et al. ..... 222/129.1
2006/0005712 A1 * 1/2006 Greenwald et al. ..... 99/275

* cited by examiner

*Primary Examiner* — Kevin P Shaver
*Assistant Examiner* — Robert Nichols, II
(74) *Attorney, Agent, or Firm* — Pyle & Piontek, LLC

(57) ABSTRACT

A system for mixing beverage components in a predetermined ratio is characterized by a housing having a mixing chamber therein, first and second inlets to the chamber and an outlet from the chamber. A first beverage component is flowed through the first inlet to the mixing chamber and a second beverage component is flowed through the second inlet to the chamber for mixing of the components in the chamber and exit of the mixture from the chamber through the chamber outlet. The pressure of the second beverage component in the second inlet is sensed upstream from the chamber and the flow of at least one of the first and second beverage components to the chamber is controlled in accordance with the sensed pressure to deliver to the mixing chamber a predetermined ratio of the first and second beverage components.

18 Claims, 3 Drawing Sheets

SYSTEM FOR MIXING BEVERAGE COMPONENTS IN A PREDETERMINED RATIO

FIELD OF THE INVENTION

The present invention relates generally to drink dispensers, and in particular to drink dispensers in which a concentrate beverage component is mixed with a diluent in desired ratios.

BACKGROUND OF THE INVENTION

Drink dispensers are well known and are used to dispense beverages for service to customers by mixing beverage concentrates with diluents in selected ratios. The beverage concentrates may be flavored concentrate syrups, such as cola syrups, that are mixed with suitable diluents, usually carbonated or plain water, to produce a beverage.

Increasing health awareness has given rise to consumer desires for drinks that provide nutrient valve, such as fruit juice beverages. Typically, drink dispensers for fruit juice beverages prepare the beverages by mixing a concentrate product, such as orange juice concentrate, apple juice concentrate, etc., with water to provide a consumable drink product. In preparing such beverages, it is important that water and concentrate be mixed together in proper predetermined ratios to insure drink quality from one drink to the next. Such ratios typically range from 2:1 (2 parts water to 1 part concentrate) to 10:1. However, special problems arise in maintaining proper mixing ratios when dispensing fruit juice beverages as compared to soft drinks. Because fruit juice concentrates often include pulp and can have a relatively high and temperature dependent viscosity, it is difficult to directly measure the flow of fruit juice concentrate in the preparation of a drink, and it thereby is difficult to control the water to concentrate ratio of the beverage. In an effort to maintain desired ratios of water to concentrate, most fruit juice dispensers are designed to rely on a flow of concentrate delivered by a metering pump that is operated at a constant speed selected in accordance with a desired flow rate of concentrate, such as by a peristaltic pump that is driven at a constant speed, together with a delivery of water that is portioned into the concentrate at a constant flow of water, where the flow of water is selected in accordance with the desired flow of concentrate, thereby to provide what is intended to be a constant ratio of water to concentrate. These systems are of the open loop type, and therefore are unable to compensate for changes in the delivery rate of concentrate due to changes in the characteristics of the concentrate. Consequently, and as changes in concentrate temperature and attendant changes in concentrate viscosity cause variations in concentrate flow, even when a peristaltic pump is operated at a constant speed, conventional fruit juice dispensers are ill equipped to maintain a desired ratio of water to concentrate in the final drink product.

OBJECTS OF THE INVENTION

A primary object of the present invention is to provide a beverage dispensing system in which first and second beverage components are brought together in a mixing chamber in a predetermined ratio that is maintained constant by regulating, in accordance with the pressure of one of the components as sensed upstream from the mixing chamber, flow of at least one of the components.

Another object of the present invention is to provide a beverage dispensing system in which the first and second beverage components are brought together in the mixing chamber in a predetermined ratio that is maintained constant by regulating, in accordance with the sensed pressure of the one component, the flow of one of the components while keeping the flow of the other component constant.

A further object of the present invention is to provide a beverage dispensing system in which the first and second beverage components are brought together in the mixing chamber in a predetermined ratio that is maintained constant by regulating, in accordance with the sensed pressure of the first component, the flow of the second beverage component while keeping the flow of the first component constant.

Yet another object of the present invention is to provide a beverage dispensing system in which the first and second beverage components are brought together in the mixing chamber in a predetermined ratio that is maintained constant by regulating, in accordance with the sensed pressure of the first component, the flow of the first beverage component while keeping the flow of the second component constant.

SUMMARY OF THE INVENTION

In accordance with the present invention, a system for mixing liquid components in a predetermined ratio comprises a mixing chamber having first and second inlets and an outlet; first means for delivering a first liquid component through the first inlet to the mixing chamber; and second means for delivering a second liquid component through the second inlet to the mixing chamber for mixing of the first and second liquid components in the mixing chamber and exit of the mixture through the outlet. Also included are means for sensing the pressure of the first liquid component in the first inlet prior to the first liquid component flowing into the mixing chamber; means for sensing the flow of the first liquid component through the first inlet; and means responsive to the first liquid component pressure and flow sensing means for controlling at least one of the first and second delivering means to vary the flow of at least one of the first and second liquid components, such that a predetermined ratio of the first and second liquid components flows to the mixing chamber. In the described embodiment the means responsive to the first liquid component pressure and flow sensing means varies the flow of at least one of the first and second liquid components, so as to bring the sensed pressure and sensed flow of the first liquid component to a predetermined one of a plurality of sets of associated pressure and flow values, thereby to provide the predetermined flow ratio of the first and second liquid components to the mixing chamber.

In one contemplated embodiment, the means responsive to the first liquid component pressure and flow sensing means controls the first delivering means to vary the flow of the first liquid component while the flow of the second liquid component remains substantially unchanged, to bring the sensed pressure and sensed flow of the first liquid component to the predetermined one of the plurality of sets of associated pressure and flow values. In another contemplated embodiment, the means responsive controls the second delivering means to vary the flow of the second liquid component while the flow of the first liquid component remains substantially unchanged, to bring the sensed pressure and sensed flow of the first liquid component to the predetermined one of the plurality of sets of associated pressure and flow values. In a further contemplated embodiment, the means responsive controls each of the first and second delivering means to vary the flow of each of the first and second liquid components, again to bring the sensed pressure and sensed flow of the first liquid component to the predetermined one of the plurality of sets of associated pressure and flow values.

The means responsive includes microprocessor based means programmed with the plurality of sets of associated pressure and flow values, and each set of the plurality of sets of associated pressure and flow values is representative of an associated set of flow values of the first and second liquid components that provide the predetermined flow ratio of the first and second liquid components to the mixing chamber.

In the described embodiment the first and second liquid components are first and second beverage components, such as juice concentrate and diluent for the concentrate, and the system is embodied in a beverage dispenser. The first delivering means and the flow sensing means comprise a dosing valve having flow metering means and flow sensing means for metering and sensing the flow of the first liquid component and the second delivering means comprises a metering pump. The mixing chamber is defined at the intersection of first, second and third tubes connected in Y-configuration, the first and second tubes respectively comprise the first and second inlets to the mixing chamber, and the third tube comprises the outlet from the mixing chamber. The first and second delivering means are at respective inlets to the first and second tubes, and the pressure sensing means senses the pressure of the first liquid component in the first tube intermediate the inlet to the first tube and the mixing chamber.

The invention also provides a method of mixing liquid components in a predetermined ratio, which method comprising the steps of flowing a first liquid component through a first inlet to a mixing chamber; flowing a second liquid component through a second inlet to the mixing chamber for mixing of the first and second liquid components in the mixing chamber and exit of the mixture through an outlet from the mixing chamber; sensing the pressure of the flow of the first liquid component in the first inlet prior to the first liquid component entering the mixing chamber; sensing the flow of the first liquid component through the first inlet; and controlling at least one of the flowing steps, in response to the first liquid component pressure and flow sensing steps, to vary the flow of at least one of the first and second liquid components through the first and second inlets, such that a predetermined ratio of the first and second liquid components flows to the mixing chamber. In the described embodiment the controlling step controls at least one of the flowing steps to vary the flow of at least one of the first and second liquid components, so as to bring the sensed pressure and the sensed flow of the first liquid component to a predetermined one of a plurality of sets of associated pressure and flow values, thereby to provide the predetermined flow ratio of the first and second liquid components to the mixing chamber.

In one practice of the method, the controlling step controls the first liquid component flowing step to vary the flow of the first liquid component while the flow of the second liquid component remains substantially unchanged, to bring the sensed pressure and sensed flow of the first liquid component to the predetermined one of the plurality of sets of associated pressure and flow values. In another practice of the method, the controlling step controls the second liquid component flowing step to vary the flow of the second liquid component while the flow of the first liquid component remains substantially unchanged, to bring the sensed pressure and sensed flow of the first liquid component to the predetermined one of the plurality of sets of associated pressure and flow values. In a further practice of the method, the controlling step controls each of the first and second liquid component flowing steps to vary the flow of each of the first and second liquid components, to bring the sensed pressure and sensed flow of the first liquid component to the predetermined one of the plurality of sets of associated pressure and flow values.

The controlling step may be performed using a microprocessor, and included is the step of programming the microprocessor with the plurality of sets of associated pressure and flow values, wherein each set of the plurality of sets of associated pressure and flow values is representative of an associated set of flow values of the first and second liquid components that provide the predetermined flow ratio of the first and second liquid components to the mixing chamber.

The steps of flowing the first liquid component and sensing the flow of the first liquid component may be performed using a dosing valve that is controllable to meter the flow of the first liquid component and has a flow meter for sensing the flow of the first liquid component and the step of flowing the second liquid component may be performed using a metering pump.

The foregoing and other objects, advantages and features of the invention will become apparent upon a consideration of the following detailed description, when taken in conjunction with the accompanying drawings.

DETAILED DESCRIPTION

Figure 1:
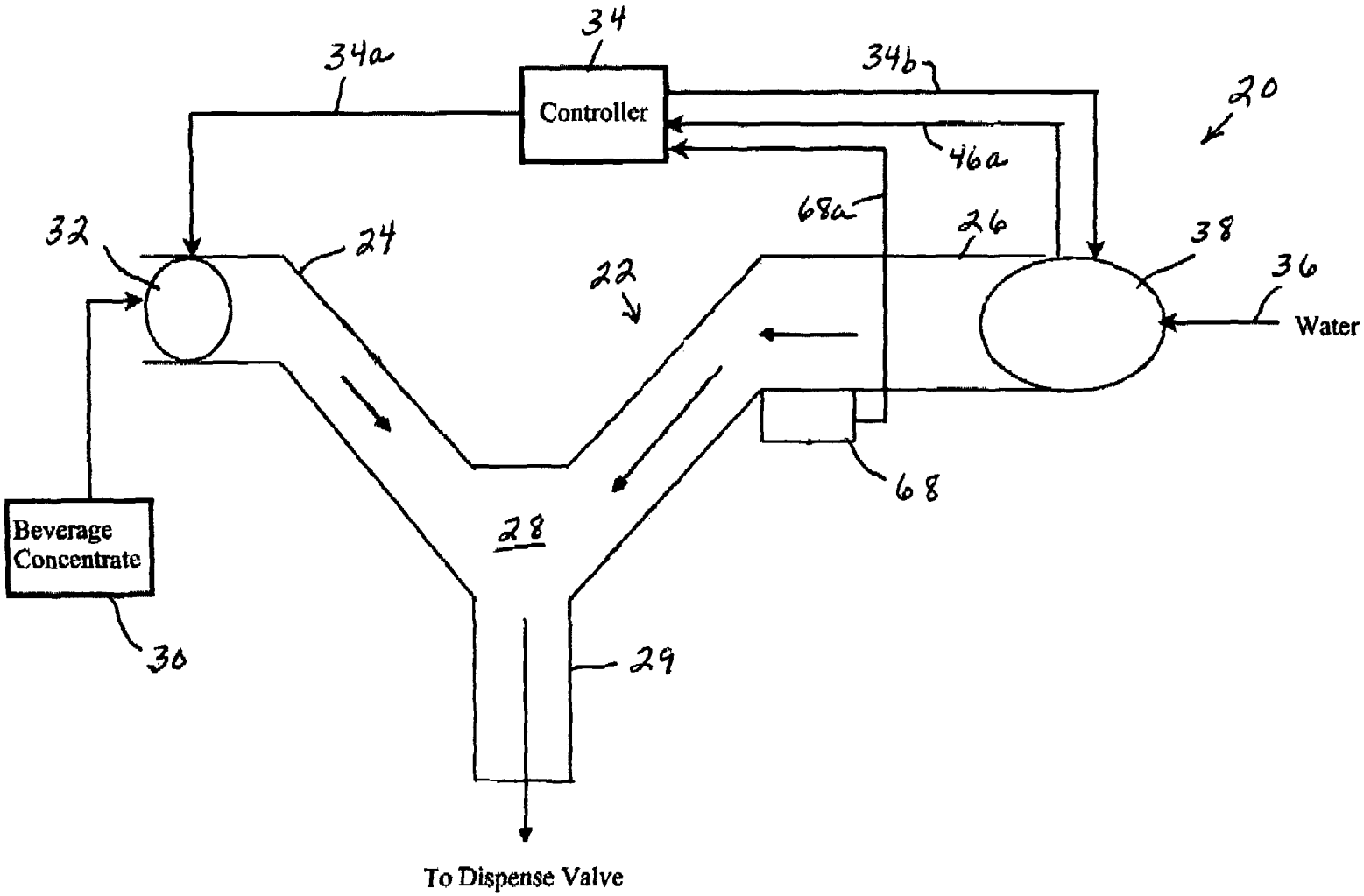
FIG. 1 is a pictorial representation of a system for mixing first and second liquid beverage components in a desired ratio in accordance with the teachings of the invention.

Beverage dispensers for mixing together liquid beverage concentrate and liquid diluent in predetermined ratios, and for dispensing the mixture as a drink for service to consumers, are well known. Some such beverage dispensers serve fruit juice drinks, such as orange juice, apple juice, etc., in which case the diluent normally is plain water while the concentrate comprises concentrated fruit juice that usually is refrigerated, often has a relatively high and temperature dependent viscosity, and may contain pulp. For consistent quality of drinks, it is important that concentrate and water always be mixed together in a predetermined ratio, depending upon the particular fruit juice drink to be served. In an attempt to maintain a desired constant ratio of water to juice concentrate, conventional practice contemplates using a metering type delivery device, such as a peristaltic pump that is driven at a constant speed during delivery of a flow of concentrate to a mixing chamber, with a regulated water supply being portioned into the mixing chamber at a flow controlled to be in accordance with the speed of operation of the concentrate metering pump. However, such prior systems are less accurate than desired in maintaining a constant ratio of water to concentrate, in that they normally are of the open loop type and therefore are unable to compensate for naturally occurring changes in the flow of concentrate delivered by a peristaltic pump to the mixing chamber. Changes in the flow of concentrate to the mixing chamber can occur, for example, because a peristaltic pump, while capable of accurately metering and delivering a selected flow of a pumped liquid if the characteristics of the liquid remain constant, cannot necessarily deliver a constant flow of liquid when changes occur in the characteristics of the liquid, even though the speed of operation of the pump is maintained constant. For example, when the pumped liquid is fruit juice concentrate that often has a relatively high and temperature dependent viscosity, changes in temperature, and therefore in viscosity, of the concentrate, as well as the presence or absence of pulp in the concentrate, can significantly affect the pumped flow of concentrate to the mixing chamber, despite the operating speed of the metering pump being controlled to be constant. The net result is that variations in the characteristics of the concentrate affect the flow of the concentrate and, thereby, the ratio of water to concentrate in the prepared beverage, which adversely impacts the quality of drinks served to consumers.

In improving upon beverage component proportioning schemes for conventional fruit juice dispensers, the invention provides a flow control system that operates to precisely control the ratio of water to fruit juice concentrate as delivered to a mixer and served from a dispensing valve of a fruit juice dispenser, despite changes in the characteristics of either or both of the water and concentrate. To provide such precise control, the system monitors flows of the concentrate and water to the mixer and the pressure of water upstream from the mixer and controls the flow of one or both of the water and concentrate, in accordance with the pressure of the water, in a manner to compensate for variations in the flow of either, to thereby maintain a constant predetermined ratio of water to concentrate as delivered to the mixer.

FIG. 1 illustrates one contemplated embodiment of system embodying the teachings of the invention, as may be used in a fruit juice dispenser. The system is indicated generally at 20 and includes a Y-tube, indicated generally at 22, for receiving at inlets 24 and 26 respective flows of liquid fruit juice concentrate and water that are brought together and mixed within a mixer comprising a mixing chamber 28 in the Y-tube From the mixing chamber, the mixture of water and concentrate flows through an outlet 29 from the Y-tube to a downstream beverage dispensing valve (not shown) of the fruit juice dispenser for being dispensed into a cup for service to a consumer.

To provide liquid fruit juice concentrate to the Y-tube inlet 24, a supply container of concentrate 30 is fluid coupled to an inlet to a metering pump 32, such as to an inlet to a motor driven peristaltic pump that may be of any suitable type known to those skilled in the art and that may be operated at various speeds to vary the flow of concentrate delivered by the pump to the Y-tube inlet 24. It is to be understood that the metering pump 32 need not necessarily be a peristaltic pump, and can be any suitable type of fluid delivery regulating pump, or fluid delivery regulating system that does not necessarily include a pump, that can be operated in a manner to control a flow of concentrate to the Y-tube inlet, although for convenience the invention will be described in terms of the metering pump being a peristaltic pump, an outlet from which is fluid coupled to the Y-tube inlet 24. An electronic control circuit or controller 34, which may be microprocessor based, operates the motor driven peristaltic pump 32 between off and on states and controls the speed of operation of the pump and thereby the flow of concentrate into the Y-tube inlet 24. From the Y-tube inlet, liquid fruit juice concentrate flows to the mixing chamber 28.

Figure 2:
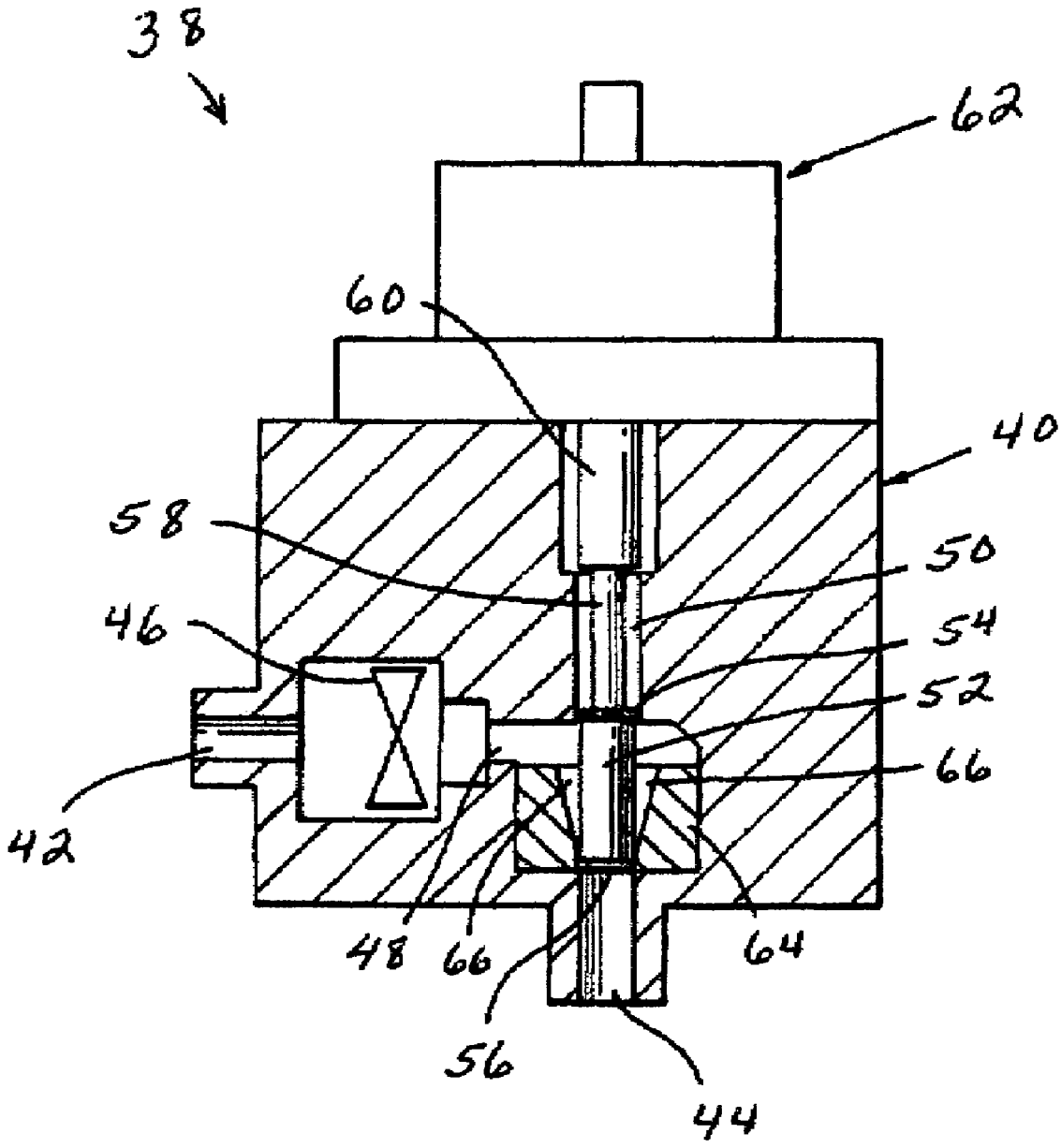
FIG. 2 shows a dosing valve of a type that can be used to measure and control a flow of one of the beverage components.

To provide water to the Y-tube inlet 26, a potable water line 36 is fluid coupled to an inlet to a dosing valve 38. The dosing valve advantageously is of a type as disclosed in U.S. Pat. No. 6,962,270, issued Nov. 8, 2005 and the teachings of which are specifically incorporated herein by reference. With reference also to FIG. 2, the dosing valve 38 includes a valve body 40 having a flow inlet 42 fluid coupled to the water line 36 and an outlet 44 fluid coupled to the Y-tube inlet 26. Water flowing through the valve inlet 42 passes through a chamber in which is a flow meter turbine 46 and then through a passageway 48 to a central passageway 50 extending through the valve body 50 at right angles to the passageway 48. The outlet 44 is a continuation of the passageway 50 and a piston 52 extends in the passageway 50 and carries at each of its ends respective seals 54 and 56 that make sealing engagement with the passageway wall. Above the seal 54, the piston connects via a smaller diameter connecting rod 58 to a drive shaft 60 of a stepper motor 62. Between the juncture of the passageways 48 and 50 and the outlet 44, the passageway 50 is connected to the outlet 44 through a central bore of a valve block 64. The valve block may have a pair of V-grooves 66 diametrically opposed across its central bore and extending axially of the bore. The grooves 66 taper to the outlet end of the bore and commence at their wider end at the far end of the valve block away from the outlet 44.

The controller 34 is electrically connected to the stepper motor 62 to operate the stepper motor in a manner to move the dosing valve piston 52 between positions fully closing and opening the valve as well as to positions therebetween to control a flow of water through the valve. When the controller operates the stepper motor to move the piston to its lowermost position as shown, the piston completely closes off, in conjunction with its lower seal 56, the central bore through the valve block 64, thereby closing the valve 38 and preventing a flow of water from the valve. When the controller operates the stepper motor to raise the piston, the valve block 64 is opened to allow a flow of water through the V-grooves 66 and from the valve outlet 44 into the Y-tube inlet 26. The further the piston 52 is raised, the greater the degree of opening through the dosing valve and the greater the flow of water into the Y-tube inlet 26. A signal generated by the flow meter turbine 46, representing of the flow of water through the dosing valve and thereby into the Y-tube inlet 26, is coupled via a lead **46*a* to the controller 34. A water pressure measuring device 68, which may be of any suitable type, is downstream from the metering valve 38 and upstream from the Y-tube mixing chamber 28 to sense the pressure of water upstream from the mixing chamber. A signal generated by the water pressure sensor, representing the pressure of water delivered to the mixer 28, is coupled to the controller 34 via a lead 68*a***.

Operation of the system 20 in maintaining a predetermined ratio of the flows of water and fruit juice concentrate delivered to the Y-tube mixing chamber 28 is predicated upon fluid dynamics. As is well known, if two flows of liquid are brought together, the upstream pressures of both flows will be affected. Thus, when a flow of concentrate and a flow of water are brought together in the Y-tube mixing chamber 28, the upstream pressure of each flow is affected. In the system 20, the water flow is introduced to the mixing chamber through the dosing valve 38, which valve has the capability of measuring and controlling the water flow. When concentrate is introduced to the mixing chamber 28 by the peristaltic pump 32, it affects the pressure of the water flow upstream from the mixing chamber, as detected by the pressure measuring device 68. The controller 34 receives from the dosing valve turbine flow meter 46 and the pressure sensing device 68 inputs representative of the flow and pressure of water delivered to the mixing chamber 28, and in response to the inputs provides control signals to the peristaltic pump 32 and to the dosing valve 38 to control the speed of operation of the pump and the degree of opening of the valve, in such manner as to introduce a selected ratio of concentrate and water into the mixing chamber.

When fruit juice concentrate is introduced into the Y-tube mixing chamber 28, in order to maintain a constant flow of water to the mixing chamber, the dosing valve must compensate by opening further and thereby increase the pressure of the water upstream from the chamber, which increase is detected by the pressure sensor 68 and applied to the control circuit 34. The amount of water pressure increase is proportional to the mass flow of concentrate introduced into the mixing chamber 28, so that by measuring the increase in water pressure, the mass flow of concentrate can be determined. In accordance with one contemplated operation of the system 20, concentrate flow is regulated by the control circuit 34 in accordance with sensed water pressure, by appropriately varying the speed of operation of the peristaltic pump 32.

To initialize or prepare the system 20 for delivering a predetermined ratio of water and fruit juice concentrate to the Y-tube mixing chamber 28, as a first step the peristaltic pump 32 is turned off and the dosing valve stepping motor 62 is operated to move the valve piston 52 to various ones of its positions between fully closed and open states of the valve, to determine water pressures that exist at the pressure sensor 68 for various flows of water in the absence of a flow of concentrate. These pressures are input to and stored by the controller 34. For any particular flow of water only and associated pressure of the water, there is a corresponding incremental change in pressure of the water that will occur at the pressure sensor 68 in response to flow of a known type of fruit juice concentrate, when the flow of concentrate is such as yields a desired ratio of water to concentrate being introduced into the Y-tube mixing chamber 28, and such incremental pressure changes as would occur at various combinations of flows of water and concentrate are entered into the controller 34. Target water pressures are then determined for the various combinations of water and concentrate flows that yield the desired ratio of water to concentrate, which target pressure for any particular combination equals the pressure of water sensed by the pressure sensor 68 when water only flows at the particular water flow rate plus the incremental pressure induced in the water when there is a flow of concentrate at the particular concentrate flow rate. Given the various target pressures, for any measured flow of water, the controller 34 can adjust the speed of operation of the peristaltic pump 32, and thereby the flow of concentrate, in a manner to provide the target pressure of water at the pressure detector 68, thereby to control the flow of concentrate such that the desired ratio of water to concentrate is delivered to the mixing chamber.

Figure 3:
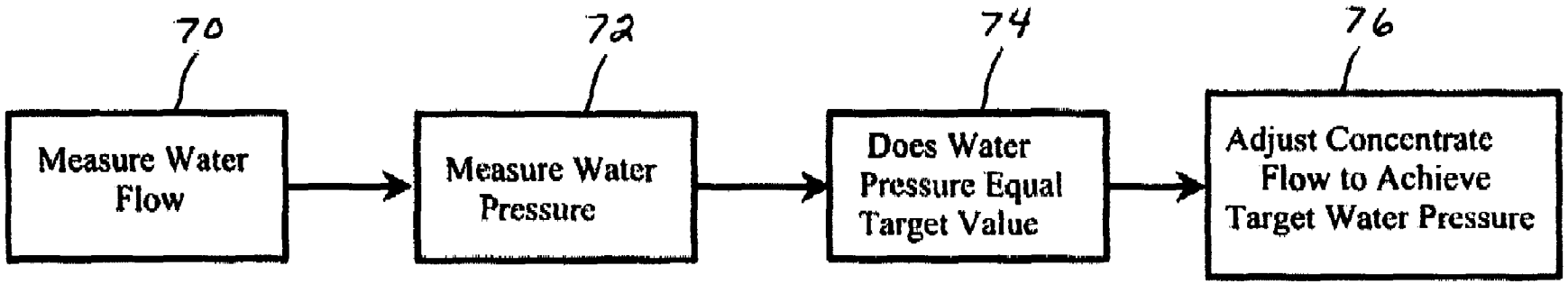
FIG. 3 is a flow chart showing operation of the system of FIG. 1 in adjusting a flow of one of the beverage components in a manner to maintain a desired ratio of the first and second beverage components in the mixture.

FIG. 3 is an algorithm as may be executed by the system 20 in maintaining a desired ratio of water to concentrate when dispensing a fruit juice beverage. Upon initiation of dispense by opening a beverage dispense valve (not shown), the peristaltic pump 32 is operated and the dosing valve 38 is opened to initiate a flow of concentrate and water to the chamber, within which the concentrate and water mix together and then flow from the chamber through the Y-tube outlet 29 to the downstream beverage dispense valve. Following initiation of flows of concentrate and water, at a box 70 the controller 34 senses the flow of water as detected by the dosing valve flow meter turbine 46, and at a box 72 the controller senses the pressure of water as detected by the water pressure detector 68. The flow of concentrate to the mixing chamber 28 adds to the to the pressure detected at the water pressure detector 68, so at a box 74 the controller determines whether, for the particular sensed flow of water, the pressure equals the target pressure. Depending upon the value of the detected pressure of water relative to the target pressure, at a box 76 the controller 34 controls the speed of operation of the peristaltic pump 32, and thereby the flow of concentrate, if and as necessary to bring the sensed pressure to the target pressure. If the sensed pressure is greater than the target pressure, the speed of operation of the peristaltic pump is reduced until the sensed pressure decreases to the target pressure. If the sensed pressure is less than the target pressure, the speed of operation of the peristaltic pump is increased until the sensed pressure rises to the target pressure.

It is understood that while operation of the system has been described with respect to adjusting the speed of operation of the peristaltic pump 32 to vary the flow of concentrate in a manner to yield, for a particular water flow, a target pressure of water at the pressure detector 68, if desired the speed of operation of the peristaltic pump could be maintained constant and the dosing valve 38 could be operated to vary the water flow in a manner to reach a target water pressure as would exist at a different water flow. In other words, with the concentrate flow being maintained constant, the dosing valve 38 can be operated to bring the water flow and water pressure to one of the predetermined associated values of water flow and pressure as have been entered into the controller 34, which will then provide the desired ratio of water and concentrate in the mixing chamber 28, since for any given flow of concentrate from the peristaltic pump, only one set of associated water flow and water pressure values exists. Alternatively, both the peristaltic pump and the dosing valve could be operated to reach a previously predetermined set of associated of water flow and water pressure values as have been entered into the controller 34, thereby to again provide a desired ratio of water to concentrate in the mixing chamber 28. Also, while the invention has been describe in respect of a single system 20 for use in a fruit juice dispenser, depending upon the number of beverage dispensing valves employed, a corresponding number of systems could be used. Further, the invention is not limited to use with fruit juice dispensers, but may also be used with other types of beverage dispensers in order to maintain a selected ratio of two beverage components. The system may also be used to provide mixtures of non-beverage liquid components in selected ratios.

While embodiments of the invention have been described in detail, various modifications and other embodiments thereof may be devised by one skilled in the art without departing from the spirit and scope of the invention, as defined by the appended claims.

What is claimed is:

1. A method of mixing liquid components in a predetermined ratio, said method comprising the steps of:

flowing a first liquid component through a first inlet to a mixing chamber;

flowing a second liquid component through a second inlet to the mixing chamber for mixing of the first and second liquid components in the mixing chamber and exit of the mixture through an outlet from the mixing chamber;

sensing the flow of the first liquid component through the first inlet;

sensing the pressure of the flow of the first liquid component in the first inlet upstream from the mixing chamber;

determining the sensed pressures of the first liquid component that exist for various sensed flows of the first liquid component when there is no flow of the second liquid component;

determining the sensed pressures of the first liquid component that exist for various sensed flows of the first liquid component when there is a flow of the second liquid component that provides a predetermined ratio of flows of the first and second liquid components to the mixing chamber;

wherein for any particular sensed flow of the first liquid component only and associated sensed pressure of the first liquid component when there is no flow of the second liquid component, a corresponding incremental increase in the sensed pressure of the first liquid component occurs in response to flow of the second liquid component when the flow of the second liquid component is such as to yield a predetermined ratio of the first and second liquid components being flowed into said mixing chamber, so that for any particular sensed flow of the first liquid component there is a target sensed pressure of the first liquid component that exists when the flow of the second liquid component is such that the predetermined ratio of the first and second liquid components is being flowed into said mixing chamber; and controlling at least one of said flowing steps, in response to said pressure and flow sensing steps during simultaneous flow of the first and second liquid components, to vary the flow of at least one of the first and second liquid components to flow the predetermined ratio of the first and second liquid components to the mixing chamber.

2. A method as in claim 1, wherein said controlling step controls at least one of said flowing steps to vary the flow of at least one of the first and second liquid components to bring the sensed pressure of the first liquid component to the target pressure for the sensed flow of the first liquid component to flow the predetermined ratio of the first and second liquid components to the mixing chamber.

3. A method as in claim 2, wherein said controlling step controls said first liquid component flowing step to vary the flow of the first liquid component while the flow of the second liquid component remains substantially unchanged to bring the sensed pressure of the first liquid component to the target pressure for the sensed flow of the first liquid component.

4. A method as in claim 2, wherein said controlling step controls said second liquid component flowing step to vary the flow of the second liquid component while the flow of the first liquid component remains substantially unchanged to bring the sensed pressure of the first liquid component to the target pressure for the then sensed flow of the first liquid component.

5. A method as in claim 2, wherein said controlling step controls each of said first and second liquid component flowing steps to vary the flow of each of the first and second liquid components to bring the sensed pressure of the first liquid component to the target pressure for the sensed flow of the first liquid component.

6. A method as in claim 2, wherein said controlling step is performed using a microprocessor, and including the step of programming the microprocessor with a plurality of sets of associated target sensed pressure and sensed flow values for the first liquid component.

7. A method as in claim 6, wherein each set of the plurality of sets of associated target sensed pressure and sensed flow values is representative of a set of target sensed pressure and sensed flow values that provide the predetermined flow ratio of the first and second liquid components to the mixing chamber.

8. A method as in claim 1, wherein said steps of flowing the first liquid component and sensing the flow of the first liquid component are performed using a dosing valve that is controllable to meter the flow of the first liquid component and has a flow meter for sensing the flow of the first liquid component.

9. A method as in claim 1, wherein said step of flowing the second liquid component is performed using a metering pump.

10. A method of operating a beverage dispenser to mix beverage concentrate and diluent in a predetermined ratio, said method comprising the steps of:

delivering diluent through a first inlet to a mixing chamber;

delivering beverage concentrate through a second inlet to the mixing chamber for mixing of diluent and concentrate in the mixing chamber and exit of the mixture from the mixing chamber through an outlet from the mixing chamber;

sensing the flow of diluent through the first inlet to the mixing chamber;

sensing the pressure of the flow of diluent in the first inlet upstream from the mixing chamber;

determining the sensed pressures of diluent that exist for various sensed flows of diluent when there is no flow of beverage concentrate;

determining the sensed pressures of diluent that exist for various sensed flows of diluent when there is a flow of beverage concentrate that provides a predetermined ratio of flows of diluent and concentrate to the mixing chamber;

wherein for any particular sensed flow of diluent only and associated sensed pressure of diluent when there is no flow of concentrate, a corresponding incremental increase in the sensed pressure of diluent occurs in response to flow of concentrate when the flow of concentrate is such as to yield a predetermined ratio of diluent and concentrate being flowed into said mixing chamber, so that for any particular sensed flow of diluent there is a target sensed pressure of diluent that exists when the flow of concentrate is such that the predetermined ratio of diluent and concentrate is being delivered into said mixing chamber; and controlling at least one of said delivering steps, in response to said pressure and flow sensing steps during simultaneous delivery of diluent and beverage concentrate into the mixing chamber, to vary the flow of at least one of the diluent and concentrate through the first and second inlets to flow the predetermined ratio of diluent and beverage concentrate to the mixing chamber.

11. A method as in claim 10, wherein said controlling step controls at least one of said delivering steps to vary the flow of at least one of the diluent and beverage concentrate to bring the sensed pressure of diluent to the target pressure for the sensed flow of diluent to flow the predetermined ratio of diluent and concentrate to the mixing chamber.

12. A method as in claim 11, wherein said controlling step controls said diluent delivering step to vary the flow of diluent while the flow of concentrate remains substantially unchanged to bring the sensed pressure of diluent to the target pressure for the sensed flow of diluent.

13. A method as in claim 11, wherein said controlling step controls said concentrate delivering step to vary the flow of concentrate while the flow of diluent remains substantially unchanged to bring the sensed pressure of diluent to the target pressure for the then sensed flow of diluent.

14. A method as in claim 11, wherein said controlling step controls each of said diluent and concentrate delivering steps to vary the flow of each of the diluent and concentrate to bring the sensed pressure of diluent to the target pressure for the sensed flow of diluent.

15. A method as in claim 11, wherein said controlling step is performed using a microprocessor, and including the step of programming the microprocessor with a plurality of sets of associated target sensed pressure and sensed flow values for the diluent.

16. A method as in claim 15, wherein each set of the plurality of sets of associated target sensed pressure and sensed flow values is representative of a set of target sensed pressure and sensed flow values that provide the predetermined flow ratio of diluent and concentrate to the mixing chamber.

17. A method as in claim 10, wherein said steps of delivering and sensing the flow of diluent are performed using a dosing valve that is controllable to meter the flow of diluent and has a flow meter for sensing the flow of diluent.

18. A method as in claim 10, wherein said step of delivering concentrate is performed using a metering pump.

* * * * *